United States Patent [19]

Corey

[11] 3,968,874

[45] July 13, 1976

[54] CONVERTIBLE CIGARETTE CASE

[75] Inventor: Donald W. Corey, Wilbraham, Mass.

[73] Assignee: Buxton, Incorporated, Agawam, Mass.

[22] Filed: Feb. 20, 1975

[21] Appl. No.: 551,375

[52] U.S. Cl. ..... 206/248; 206/259

[51] Int. Cl.[2] ..... B65D 85/10; B65D 5/50; A24F 15/00

[58] Field of Search ..... 206/248, 259, 45.16, 206/804

[56] References Cited

UNITED STATES PATENTS

| | | | |
|---|---|---|---|
| 1,570,963 | 1/1926 | Hamilton | 206/45.16 |
| 3,081,867 | 3/1963 | Corey | 206/248 |
| 3,395,787 | 8/1968 | Plaskan | 206/259 |
| 3,589,505 | 6/1971 | Burniski | 206/248 |

*Primary Examiner*—William T. Dixson, Jr.
*Attorney, Agent, or Firm*—Chapin, Neal and Dempsey

[57] ABSTRACT

Case for accommodating cigarette packages of three different lengths. Two supports of right-angled L-shape are pivoted on the bottom wall of the case for selectively swinging into and out of an operative position and holding each package of lesser length in a desired position relative to the open end of the case.

7 Claims, 5 Drawing Figures

Fig. 1.
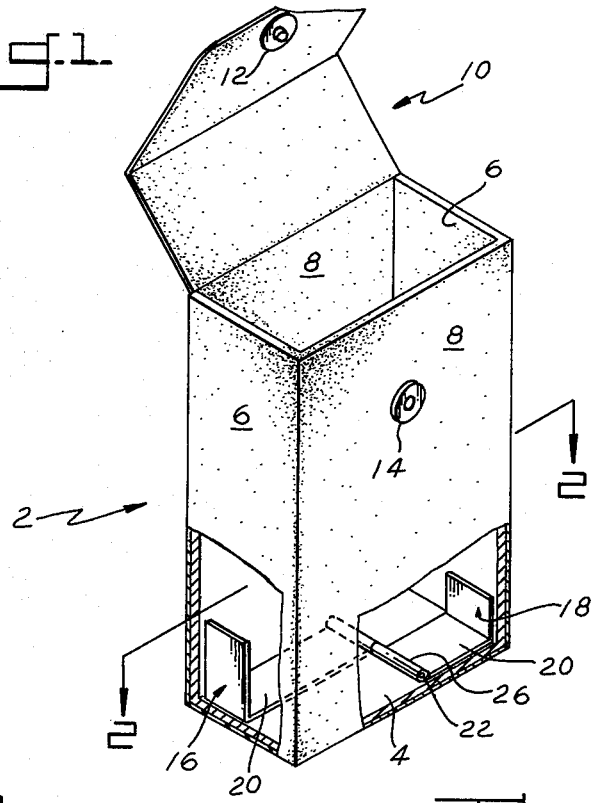
Fig. 2.
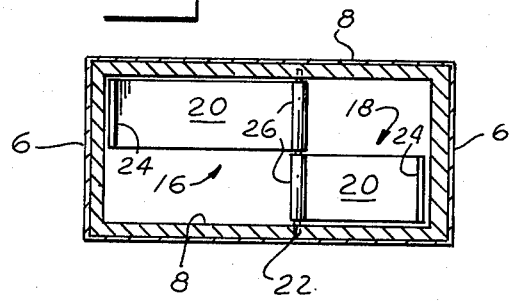
Fig. 3.
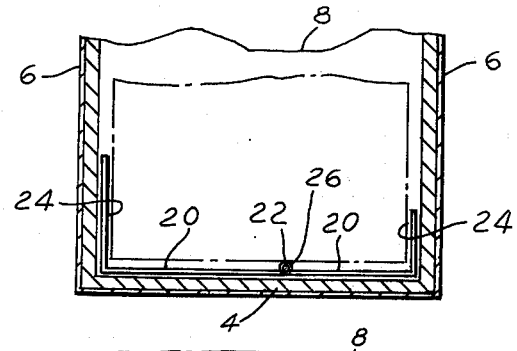
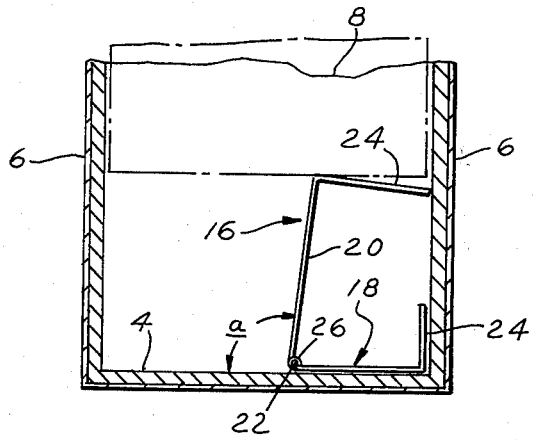
Fig. 4.
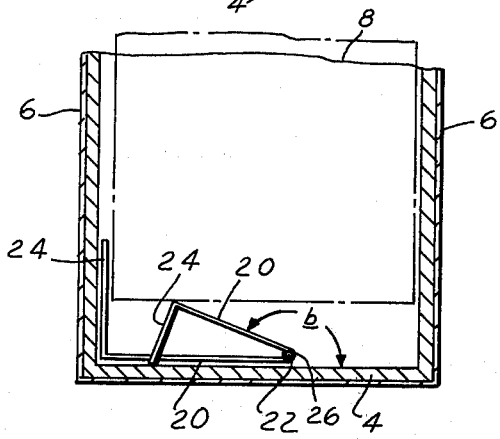
Fig. 5.

CONVERTIBLE CIGARETTE CASE

BACKGROUND

This invention relates to cigarette cases for holding standard size packages of cigarettes of three different lengths, and in particular to a case having a simple, inexpensive mechanism for readily converting the case to contain in suitable fashion packages of "regular", "king size", or "100 mm" cigarettes.

As is well known, packages for these three types of cigarettes are for all practical purposes of substantially identical dimensions with the exception of the overall length. Accordingly, a case dimensioned in height to contain the longest cigarette package will also be suitable for housing the two smaller size packages as long as the upper end of either is positioned at the same level near the open end of the case thus providing convenient access to cigarettes in the usual manner. In the trade cigarette cases have heretofore been adapted for housing regular and king size packs by supporting the bottom at different levels so that either package may be disposed at the same height relative to the open end of the case. One such example is the disclosure of U.S. Pat. No. 3,395,787, in which means are provided for telescopically sliding and positioning a movable bottom wall supported by the side walls of the casing into one of three positions.

In U.S. Pat. No. 3,081,867 granted to the present inventor, a cigarette case is disclosed for accommodating two different size packages and in which a pivotable shelf member is provided to swing to and from its operative pack-supporting position. The present device is designed to accommodate still another package size and utilizes two support members of right-angled L-shaped configuration in a novel manner and so that each member can be readily flipped into place and the effective depth of the case altered to engage a package bottom for suitable positioning of the outer end relative to the open end of the case.

The principal object of this invention is to provide a simple, inexpensive and effective means for modifying a cigarette case to accommodate all three lengths of cigarette packages currently being sold in the United States.

SUMMARY

The cigarette case of the present invention may be of any conventional casing construction having one end provided with a hinged top cover or lid and in which the depth of the case is adapted to receive the 100 mm cigarette pack with its upper end adjacent the edge of the cover end of the case.

Pivotally mounted within the case at its bottom wall are two pivotable supports. Each support includes a pivotable lever arm portion and a stand off arm or link extending generally perpendicular from the lever arm. Each support when in inoperative position lies flat against the bottom and upright walls of the case so as not to inhibit the free insertion fully into the case of the bottom of a cigarette pack. The lever arm and stand off links are so dimensioned as to provide selective support means of different height related to the difference in length of regular and kind size cigarette packs.

DRAWINGS

FIG. 1 is a perspective view with parts cut away of an embodiment of the invention;

FIG. 2 is a section on line 2—2 of FIG. 1;

FIG. 3 is a side elevation, partially in section, showing the parts arranged to accommodate a 100 mm cigarette package;

FIG. 4 is a view similar to FIG. 3 showing one support member in operative position to accommodate a regular cigarette package; and FIG. 5 is a view similar to FIG. 4 showing the other support member in operative position supporting a king size cigarette package.

Referring in detail to the drawings, a cigarette case of the type embodying this invention is shown generally at 2. The case has a generally rectangular bottom panel or wall 4 with upstanding side walls 6 and front and rear walls 8. Hingedly connected to the top of the rear wall is a closure member 10 having a snap fastener element at 12 to releasably engage a companion element at 14 on the front wall. As previously stated, the full depth of the chamber defined by walls 6 and 8 is sufficient for receiving the largest size or the 100 mm cigarette package.

At or adjacent the bottom wall and for altering the effective depth of the casing are pivoted two angled support members or "flippers" 16 and 18. As shown, each support member is formed of a flat sheet material, such as metal or synthetic plastic, having a lever arm portion 20 hinged at one end to a pivot pin 22 and a stand off link 24 which extends at a dihedral perpendicularly from the lever arm portion 20 so as to extend upwardly from the lever arm 20 when the latter lies against the bottom of the case as shown in FIG. 3.

The pivot pin 22 is fitted near the bottom of the case by its outer ends being received in suitable holes or recesses in the opposite sides of the walls 8.

The inner ends of the lever arms 20 are each formed with a cylindrical hinge portion 26 through which the pin 22 extends so as to provide a fit enabling a free pivotal action of the support members 16 and 18. The two supports are fitted in end-to-end relation on the pivot 22 so that each is free to swing independently of the other through an obtuse angle, one adjacent the back wall of the case and the other adjacent the front wall. The lever arm 20 of support 16 is substantially longer than the lever arm of support 18 and the pivot pin 22 is located so that both will lie flat against the bottom of the case, as shown in FIG. 4. In this condition, each of the stand off arms 24 lie flush with the side walls 6 of the case. The stand off arm 24 of the larger support 16 is slightly shorter in length than the distance from pivot pin 22 to the closer side wall 6, so that in its operative position the arm 20 will be somewhat inclined toward the side wall 6 at a small angle from the vertical. This means that from its FIG. 3 to its FIG. 4 position, the arm is swung through an obtuse angle greater than 90° and thus the support has greater positional stability in the operative position than if the lever were disposed vertically. The weight of the cigarette pack engaged with the uppermost corner or apex of the support as shown in FIG. 4 urges the support to its pack supporting position.

The lever arm 20 of support 18 is substantially shorter than arm 20 of support 16 and stand off link 24 of the formula is also substantially shorter than its lever arm. When the support 18 is swung through an obtuse angle to its FIG. 5 position, the lower edge of stand off link 24 engages the bottom of the case, and together with the lever 20 and the bottom of the case defines a triangle so that the uppermost corner or vertex of the support 18 is located at a height above the bottom to support a king size package of cigarettes with its upper edge at the top of the case.

As previously mentioned, by merely tilting the case from one side to the other, the supports may be swung to different operative positions, as shown in FIGS. 3, 4 and 5. From the inactive support positions in FIG. 3, it is clear that tilting the top of the empty case to the right will result in a gravity induced swing of the support 16 through an angle a greater than 90° to the position shown by FIG. 4. Likewise, an opposite tilting to the left will result in displacement of the angled supports to the position of FIG. 5 with support 18 being swung through angle *b* greater than 90°. By reference to FIGS. 4 and 5, it will be seen that both support members are pivotable in opposite directions through obtuse angles from the bottom of the case. The larger support 16 is disposed to swing in a path adjacent the back wall of the case, while the shorter support swings in a path adjacent the front wall. A tilting in the appropriate direction accompanied by a sharp flipping action of the case will carry the parts into their desired positions, while a slower rocking or shaking will readily return the supports to their inoperative positions shown in FIG. 3 for holding a 100 mm pack. In FIG. 4, the support 16 forms a quadrilateral with the corner of the case and its stand off link 24 rests against that side wall of the case which is closer to the pivot 22. The apex of support 16 is shown supporting a regular size cigarette pack. In FIG. 5 the support 18 forms a triangle with the bottom of the case with its stand off link resting against the bottom and the vertex of support 18 is shown supporting a king size pack. The pivot 22 is located at unequal distances from the side walls 6, which inequality is approximately equal to the differences in length between the lever arm portions of the two supports. It will thus be appreciated that the height difference from the outer corner of support 18 to the corresponding corner of support 16 in the respective operating positions is equal to the length difference between king and regular size cigarette packages. This arrangement provides a compact means for accommodating three different length cigarette packages and which despite its ease of operation provides supports of good positional stability in all three positions.

What is claimed is:

1. In a convertible cigarette case having a bottom and upright front, back and side walls extending from said bottom to a height adapted to accommodate three different lengths of cigarette packages, support means for the shortest and intermediate cigarette packages comprising two pivotable support members each having a lever arm portion disposed at a first position against the bottom of said case and provided with a stand off link extending at a dihedral angle from the lever arm thereof and disposed generally parallel to and closely adjacent an upright side wall of the case when the lever arm is against the bottom thereof in said first position for receiving the longest of said three different lengths of cigarette packages, said support members being selectively pivotable on an axis parallel to said side walls in opposite directions through obtuse angles from the bottom of said case to cigarette package supporting positions for said shortest and intermediate packages.

2. In a convertible cigarette case as set forth in claim 1, support means in which the stand off link of one of said support members engages a side wall of said case when in said package supporting position and in which the stand off link of the other of said support members engages the bottom of said case when in said package supporting position.

3. In a convertible cigarette case as set forth in claim 2, support means in which the lever arm portion of said one support member is substantially longer than the lever arm portion of the other support member, each lever arm being pivotable about a pivot pin disposed transversely across the bottom between the front and back walls of the case, said pin being at unequal distances from the side walls, the difference between said distances being approximately equal to the difference in length of the lever arm portion of the one and the other support members.

4. In a convertible cigarette case as set forth in claim 3 in which said support members are pivotable through obtuse angles in parallel paths, one path being adjacent the front wall and the other path being adjacent the back wall.

5. In a convertible cigarette case as set forth in claim 2, support means in which the other support member defines with said bottom a triangular figure the vertex of which is at a height above the bottom equal to the difference between said longest package and said intermediate package of cigarettes and in which the one support member forms with the bottom and side wall of the case a quadrilateral figure, the dihedral angle of said latter member being disposed above the bottom of the case a distance equal to the difference between the length of said shortest package and said longest package of cigarettes.

6. In a convertible cigarette case as set forth in claim 2, support means in which the lever arm of the one support member is tilted toward the side wall engaged by the stand off link thereof.

7. Convertible cigarette case for three different length cigarette packages comprising a bottom and upright walls extending from said bottom to a height adapted to accommodate the longest of said packages and two pivotable support members each having a lever arm portion pivotable between a first position disposed against the bottom of said case and with a stand off link extending at a dihedral angle from the arm and disposed generally parallel to and closely adjacent an upright wall of said case when the arm portion is against the bottom, each of said supports being pivotable to a second cigarette package supporting position in which the arm portion is swung through an obtuse angle from its first position, the lever arm of one of said supports being substantially longer than the lever arm of the other and the stand off link of the one support being dimensioned to engage the side wall of the case when the arm thereof is in an upright position with the dihedral angle thereof disposed above the bottom of the case a distance approximately equal to the difference in length between the longest and shortest cigarette packages, the stand off link of the other support when its outer edge abuts the bottom having a length to support the lever arm thereof at an acute angle relative to the bottom of the case and defining with said bottom a triangular figure with its vertex spaced above the said bottom a distance equal the difference in length between the longest and intermediate length cigarette packages.

* * * * *